US005961024A

United States Patent [19]

Wright, Jr.

[11] Patent Number: 5,961,024

[45] Date of Patent: Oct. 5, 1999

[54] DOWEL PIN INSERTION DEVICE WITH HEIGHT INDICATOR

[75] Inventor: Paul Edward Wright, Jr., Ashtabula, Ohio

[73] Assignee: W.R. Engineering Inc., Grand River, Ohio

[21] Appl. No.: 08/953,870

[22] Filed: Oct. 18, 1997

[51] Int. Cl.[6] ..... B25C 1/02; B25C 7/00

[52] U.S. Cl. ..... 227/147; 227/142; 173/20

[58] Field of Search ..... 227/147, 142, 227/156; 173/20, 21, 90

[56] References Cited

U.S. PATENT DOCUMENTS

| | | | |
|---|---|---|---|
| 420,074 | 1/1890 | Jones | 227/147 |
| 1,246,070 | 11/1917 | Duckworth | 227/147 |
| 2,588,738 | 3/1952 | Lundgren | 227/147 |
| 3,060,440 | 10/1962 | Pfaff et al. | 227/147 |
| 3,074,719 | 1/1963 | McKee | 227/142 |
| 3,342,228 | 9/1967 | Reid | 227/147 |
| 4,179,058 | 12/1979 | Yost | 227/147 |
| 4,838,471 | 6/1989 | Chiesa | 227/142 |
| 5,529,234 | 6/1996 | Juneau | 227/147 |
| 5,533,660 | 7/1996 | Meier | 227/147 |

*Primary Examiner*—Scott A. Smith
*Attorney, Agent, or Firm*—Forrest L. Collins

[57] ABSTRACT

A device for guiding and inserting dowel pins into tooling plates while also indicating the height to which it has been inserted; which comprises a means to transfer an external force to the dowel pin, a means to guide and hold the dowel pin perpendicular to the plate into which the dowel pin is to be inserted, and a means to indicate the position or height to which the dowel pin has been inserted.

2 Claims, 4 Drawing Sheets

DOWEL PIN INSERTION DEVICE WITH HEIGHT INDICATOR

BACKGROUND OF INVENTION

1. Field of Invention

This invention relates generally to a device for guiding and inserting dowel pins while also indicating their height.

2. Description of the Prior Art

Dowel pins and cylindrical type locators are currently inserted into tooling plates by either, pressing with an arbor press or by tapping with a hammer. Dowel pins are generally made of a material that is harder than the material into which it is to be installed, this allows the dowel pin to walk or become angled as it is inserted into the plate. The hammer method is most often used to install dowel pins. When using this method it is often difficult to hold and guide the pin, while tapping. Once the pin is started there is no way to insure that the pin will be perpendicular to the plate. These same problems exist when using an arbor press. If a certain height is required of the pin, it will be required to stop inserting and measure the position of the pin several times through out the insertion until the desired height is reached. This method is inefficient and time consuming. This invention eliminates these problems.

SUMMARY OF THE INVENTION

The invention relates to a device for guiding and inserting dowel pins while also indicating their height. It comprises a means to transfer a force to the dowel pin, a means to guide, and hold the dowel pin, and a means to indicate the height to which the dowel pin is being inserted. The object of the invention is to provide a fast and efficient method of inserting dowel pins that would eliminate excess handling and problems caused by dowel pins inserted at an angle.

LIST OF REFERENCE NUMERALS

Figure 1:
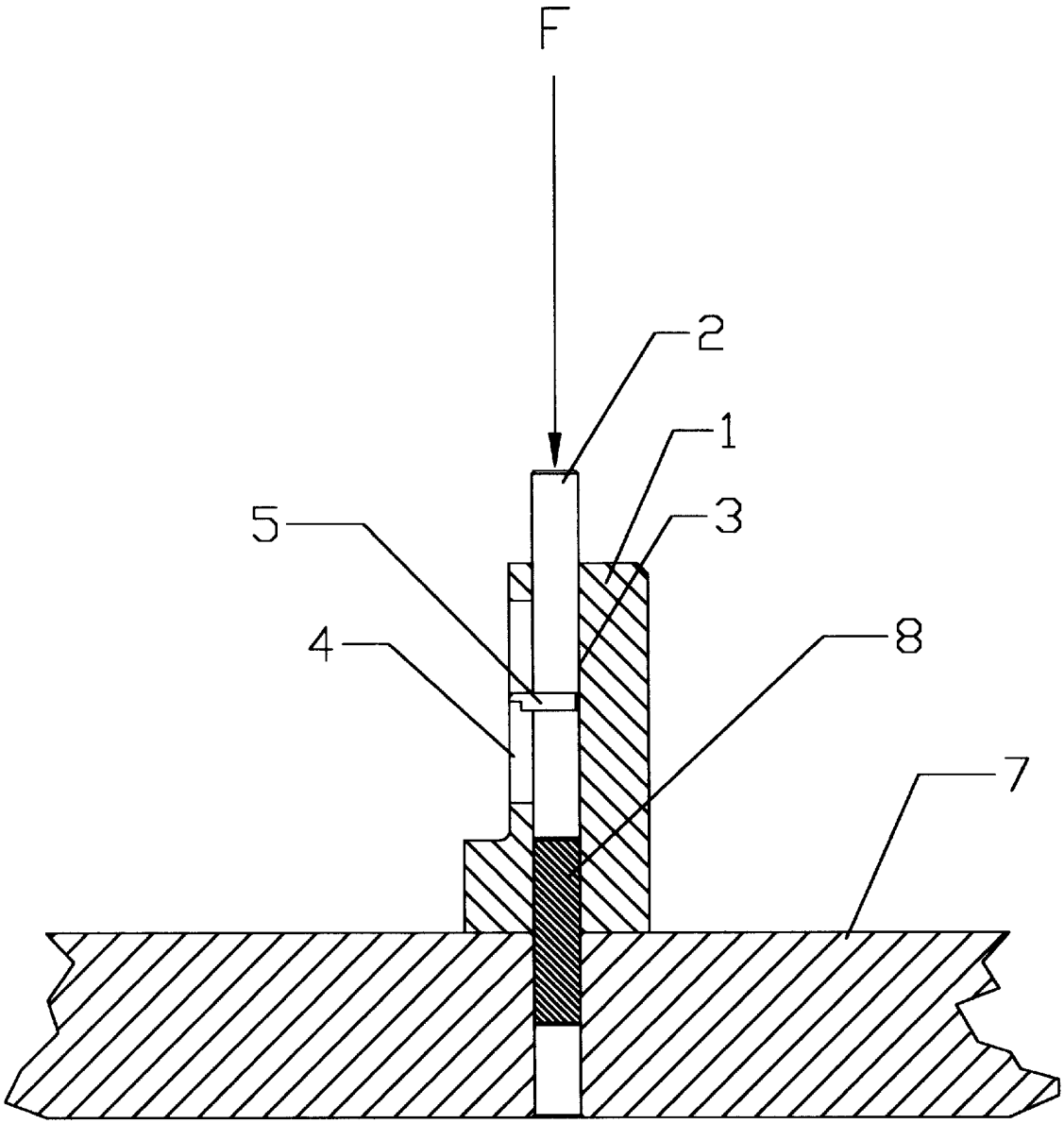
FIG. 1 is a section view taken at 1—1 on FIG. 2, showing the vertical slot, indicator/stop, and the push rod in relation to the dowel pin.

1. Body
2. Push rod
3. Axial Channel
4. Slot
5. Indicator/Stop
6. Linear Scale
7. Tooling Plate
8. Dowel pin

DESCRIPTION OF THE PREFERRED EMBODIMENT

Referring to FIGS. 1,2,3, & 4, an embodiment of the DOWEL PIN INSERTION DEVICE WITH HEIGHT INDICATOR is shown. In this embodiment, the DOWEL PIN INSERTION DEVICE WITH HEIGHT INDICATOR is comprised of: a body 1, which may be comprised of a hardened steel member with an axial channel 3 along the body's 1 long axis and a radial opening through one side forming a slot 4; a push rod 2 which may be comprised of a hardened steel member, with an opening radially through the side; a steel indicator/stop 5 , and a linear scale 6. Force F is defined as any external force required to push the dowel pin 8 into the plate 7 into which it is to be inserted.

In this embodiment, a means of transferring force F to the dowel 8 is the push rod 2. Referring to FIG. 1, the push rod 2 is slipped into the axial channel 3 of the body 1 and captivated by the indicator pin/stop 5 pressed through the slot 4 into the push rod 2. The indicator/stop 5 slides up and down the slot 4 as the push rod 2 moves up and down the axial channel 3, limiting the push rod 2 to a set linear distance of travel determined by the length of the slot 4.

Figure 2A:
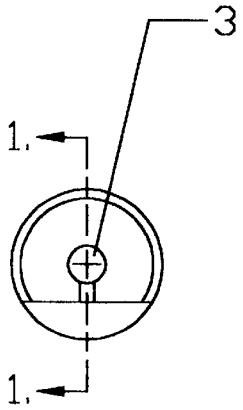
FIG. 2 is a combination plan view and an elevation view of the DOWEL PIN INSERTION DEVICE WITH HEIGHT INDICATOR, sitting as it would function on a section of tooling plate.
Figure 2B:
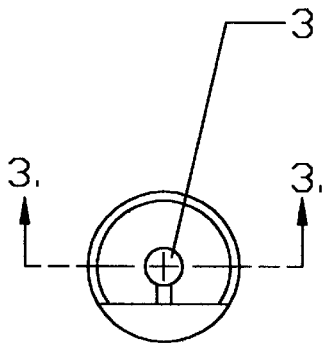
Figure 2C:
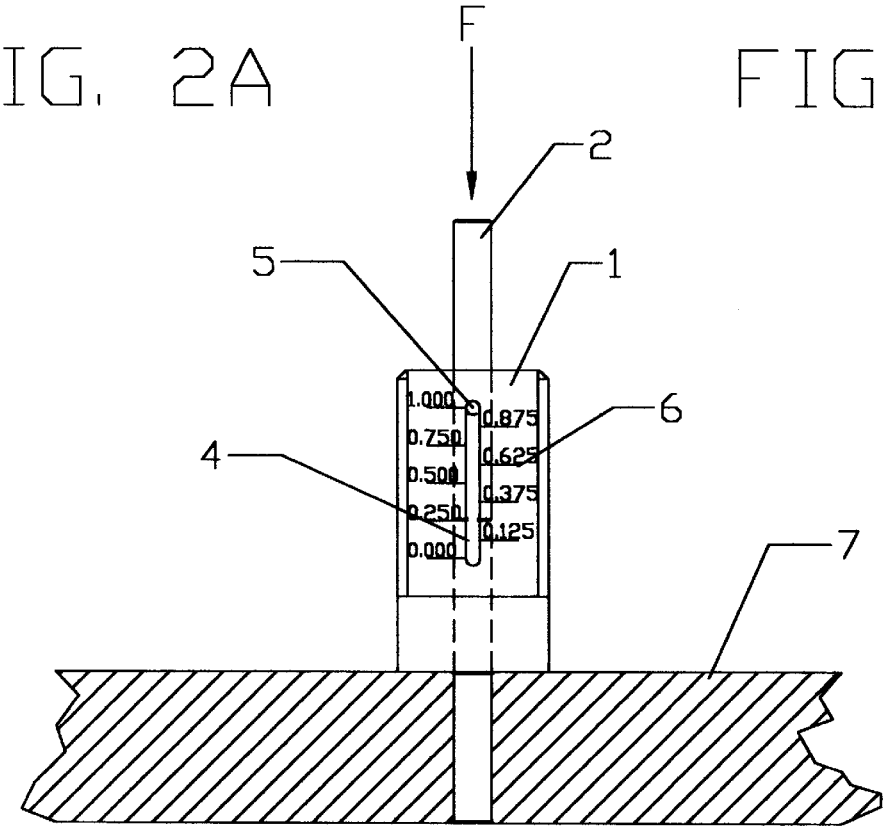
Figure 3:
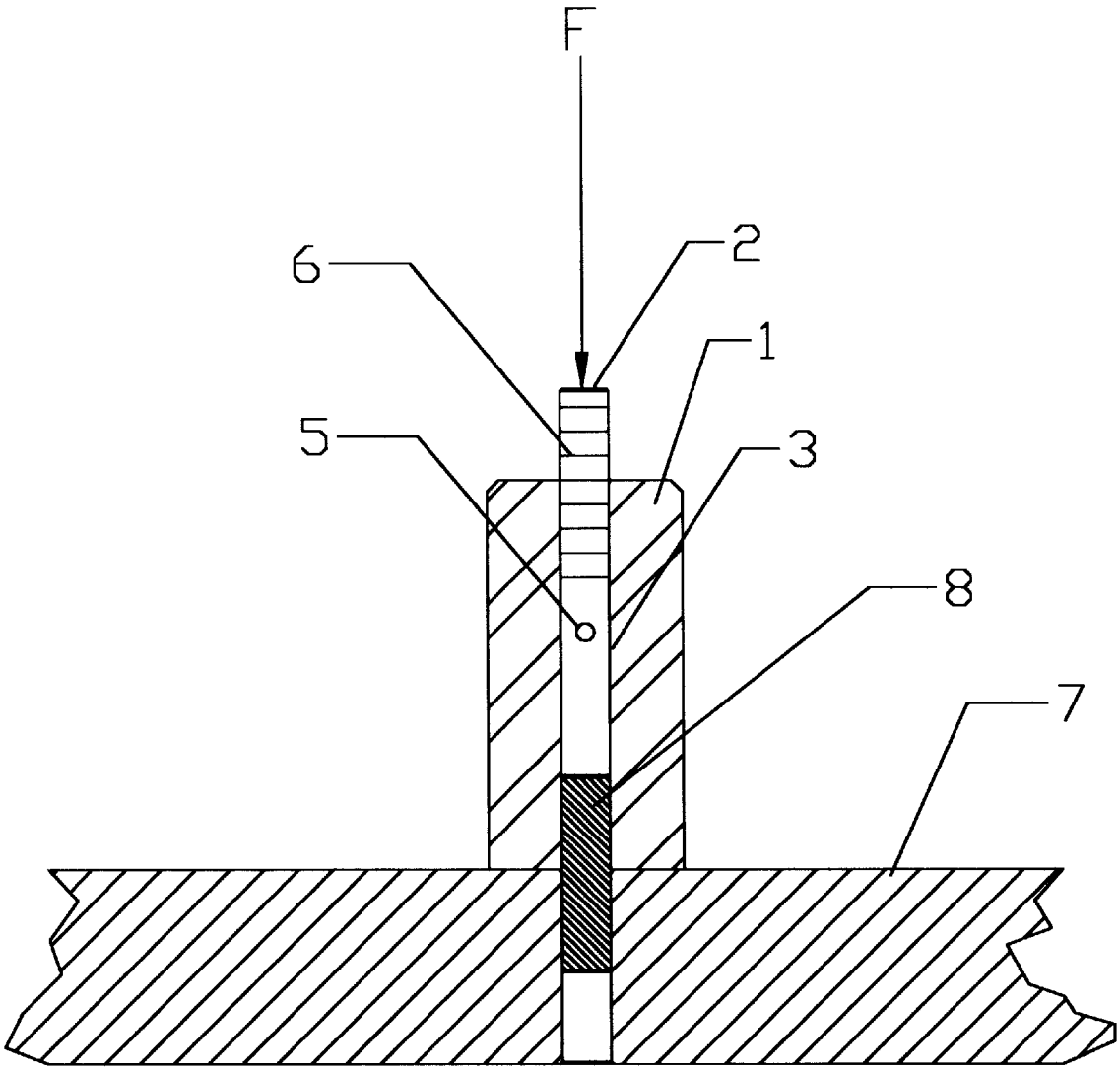
FIG. 3. is a section view taken at 3—3 on FIG. 2, with a dowel pin partially inserted to a set position in the tooling plate and a linear scale of lines formed around the push rod.

Referring to FIG. 2, a linear scale 6 comprised of lines spaced at a set linear distance is formed into the body 1 around the slot 4 as the push rod 2 slides up and down, the indicator/stop 5 moves through the slot 4 along the scale 6 indicating the linear distance to which the push rod 2 has traveled. Referring to FIG. 3, the dowel pin 8 is inserted into the axial channel 3 in the body 1 opposite the push rod 2. The body I is then aligned with the opening, in the plate 7 into which the dowel pin 8 is to be inserted. The surface of the body 1, that contacts the plate 7 that the dowel pin 8 is to be inserted, is perpendicular to the body's 1 centerline. The body 1 acts as guide to hold the dowel pin 8 straight and perpendicular to the plate 7 into which it is being inserted. Force F is then applied to the push rod 2 to insert the dowel pin 8 into the plate 7.

Figure 4:
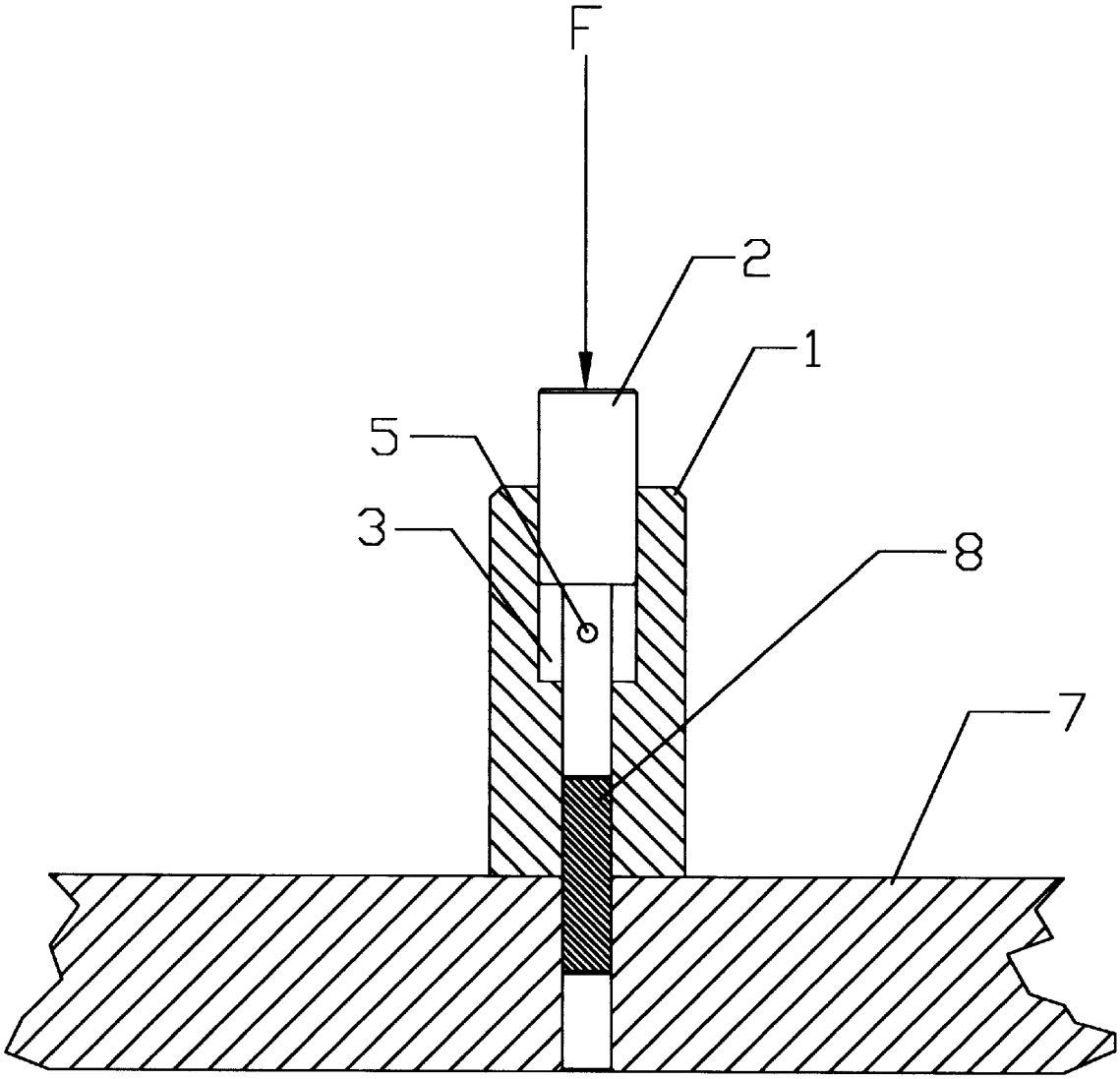
FIG. 4 is a section view taken at 3—3 on FIG. 1, showing an alternate push rod configuration.

Although one detailed embodiment of the invention is illustrated in the drawings and described in detail, this invention contemplates any configuration, design and relationship of components which will function in a similar manner and which will achieve the equivalent result. For example, FIG. 4 shows an alternate push rod 2 configuration which would provide an improved striking surface. Refer to FIG. 3, the linear scale 6 may be rings spaced at a set linear distance formed on the push rod 2. As the push rod 2, moves up and down, the space between the rings on the push rod 2 indicate the distance traveled.

I claim:

1. A dowel pin insertion device comprising a body and a push rod;

said body having a first body end, a second body end, and a body length and said body length having a long axis;

said first body end having surface means defining a first body opening;

said second body end having surface means defining a second body opening;

said first body opening and said second body opening defining a channel axially communicating though said body length;

said push rod having a first push rod end surface, a second push rod end surface, a length and a width;

a slot in said body, said slot communicating with said channel;

said push rod axially disposed along its length in said channel; and, said push rod having a stop to retain said push rod in said channel wherein said stop is at least partially within said slot and wherein said push rod is marked for, when a dowel pin is aligned with said channel, determining the amount of the dowel pin in said channel, provided further that said channel has a constant diameter from said first body opening and said second body opening.

2. A dowel pin insertion device comprising a body and a push rod;

said body having a first body end, a second body end, and a body length and said body length having a long axis;

said first body end having surface means defining a first body opening;

said second body end having surface means defining a second body opening;

said first body opening and said second body opening defining a channel axially communicating through said body length;

said body having a slot, said slot communicating with said channel, said slot extending along the long axis of said body length but not extending through at least one end of said body;

said push rod having a length and a width, said push rod axially disposed along its length in said channel;

said push rod having a stop to retain said push rod in said channel and wherein said stop is at least partially within said slot, wherein the body is marked along said slot for, when a dowel pin is aligned with said channel, determining the amount of the dowel pin in said channel; ps provided further that said channel has a constant diameter from said first body opening and said second body opening.

* * * * *